US005141472A

United States Patent [19]

Todd et al.

[11] Patent Number: 5,141,472

[45] Date of Patent: Aug. 25, 1992

[54] DISC-TYPE COIN SORTER WITH ADJUSTABLE GAGING DEVICE

[75] Inventors: William M. Todd, Tullahome, Tenn.; James M. Rasmussen, Chicago, Ill.

[73] Assignee: Cummins-Allison Corp., Mt. Prospect, Ill.

[21] Appl. No.: 606,043

[22] Filed: Oct. 30, 1990

[51] Int. Cl.[5] ..... G07D 3/00

[52] U.S. Cl. ..... 453/10

[58] Field of Search ..... 453/3, 6, 10

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen . | |
| 4,549,561 | 10/1985 | Johnson et al. . | |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman . | |
| 4,607,649 | 8/1986 | Taiple et al. . | |
| 4,681,128 | 7/1987 | Ristvedt et al. | 453/6 |
| 4,731,043 | 3/1988 | Ristvedt . | |
| 4,775,353 | 10/1988 | Childers et al. . | |
| 4,775,354 | 10/1988 | Rasmussen . | |
| 4,863,414 | 9/1989 | Ristvedt et al. . | |
| 4,921,463 | 5/1990 | Primdahl et al. . | |
| 4,966,570 | 10/1990 | Ristvedt et al. . | |
| 5,009,627 | 4/1991 | Rasmussen . | |
| 5,011,455 | 4/1991 | Rasmussen . | |
| 5,026,320 | 6/1991 | Rasmussen . | |

FOREIGN PATENT DOCUMENTS 0301683 2/1989 European Pat. Off. ..... 453/6

*Primary Examiner*—F. J. Bartuska

*Attorney, Agent, or Firm*—Stephen G. Rudisill

[57] ABSTRACT

A coin-sorting system having a rotatable disc with a resilient surface for receiving coins of mixed denominations and imparting rotational movement to the coins; a drive for rotating the disc; and a stationary sorting head having a contoured surface spaced slightly away from and generally parallel to the resilient surface of the rotatable disc. The sorting head forms at least three discharge stations spaced along the periphery of the head for selectively discharging coins according to the radial locations of the inner edges of the coins; a queuing region for aligning the inner edges of all the coins at a common radius so that the outer edges of coins of different denominations are offset from each other, the common radius corresponding to the radial location of the inner edges of the coins that are discharged at the first discharge station; and an adjustable guide member for engaging the outer edges of coins of selected denominations and displacing those coins inwardly so that the inner edges of different denominations of the displaced coins correspond to the radial locations of the inner edges of the coins that are discharged at the second and third discharge stations. The adjustable guide member can be positioned to alter the selected denominations that are displaced inwardly to change the coin denominations that are discharged at the three discharge stations, whereby different combinations of coin denominations may be sorted and discharged at the three discharge stations.

11 Claims, 6 Drawing Sheets

DISC-TYPE COIN SORTER WITH ADJUSTABLE GAGING DEVICE

FIELD OF THE INVENTION

The present invention relates generally to coin sorting devices and, more particularly, to coin sorters of the type which use a resilient disc rotating beneath a stationary sorting head for sorting coins of mixed denominations.

SUMMARY OF THE INVENTION

It is a primary object of the present invention to provide a versatile, low-cost coin sorter which can be used in a variety of different applications.

Another related object of the invention is to provide such an improved coin sorter which is capable of sorting and discharging any desired combination of coin denominations from a mixture of coins of different denominations which can be quickly stopped by braking each time a preselected number of coins of the same denomination have been ejected from the sorter.

Other objects and advantages of the invention will be apparent from the following detailed description and the accompanying drawings.

In accordance with the present invention, the foregoing objectives are realized by providing a coin-sorting system having a rotatable disc with a resilient surface for receiving coins of mixed denominations and imparting rotational movement to the coins; means for rotating the disc; a stationary sorting head having a contoured surface spaced slightly away from and generally parallel to the resilient surface of the rotatable disc, the sorting head forming a plurality of discharge stations spaced along the periphery of the head for selectively discharging coins according to the radial locations of the inner edges of the coins; a queuing region for arranging all the coins in a single layer and in single file, and an adjustable guide member for engaging the outer edges of coins of at least selected denominations and displacing those coins inwardly so that the inner edges of different denominations of coins are positioned to be discharged via different ones of the discharge stations. In use, the position of the adjustable guide member can be adjusted to alter the selected denominations that are displaced inwardly to change the coin denominations that are discharged at the various discharge stations, whereby different combinations of coin denominations may be sorted and discharged at the discharge stations. As used herein, the term "coins" includes tokens.

DESCRIPTION OF THE PREFERRED EMBODIMENT

Figure 1:
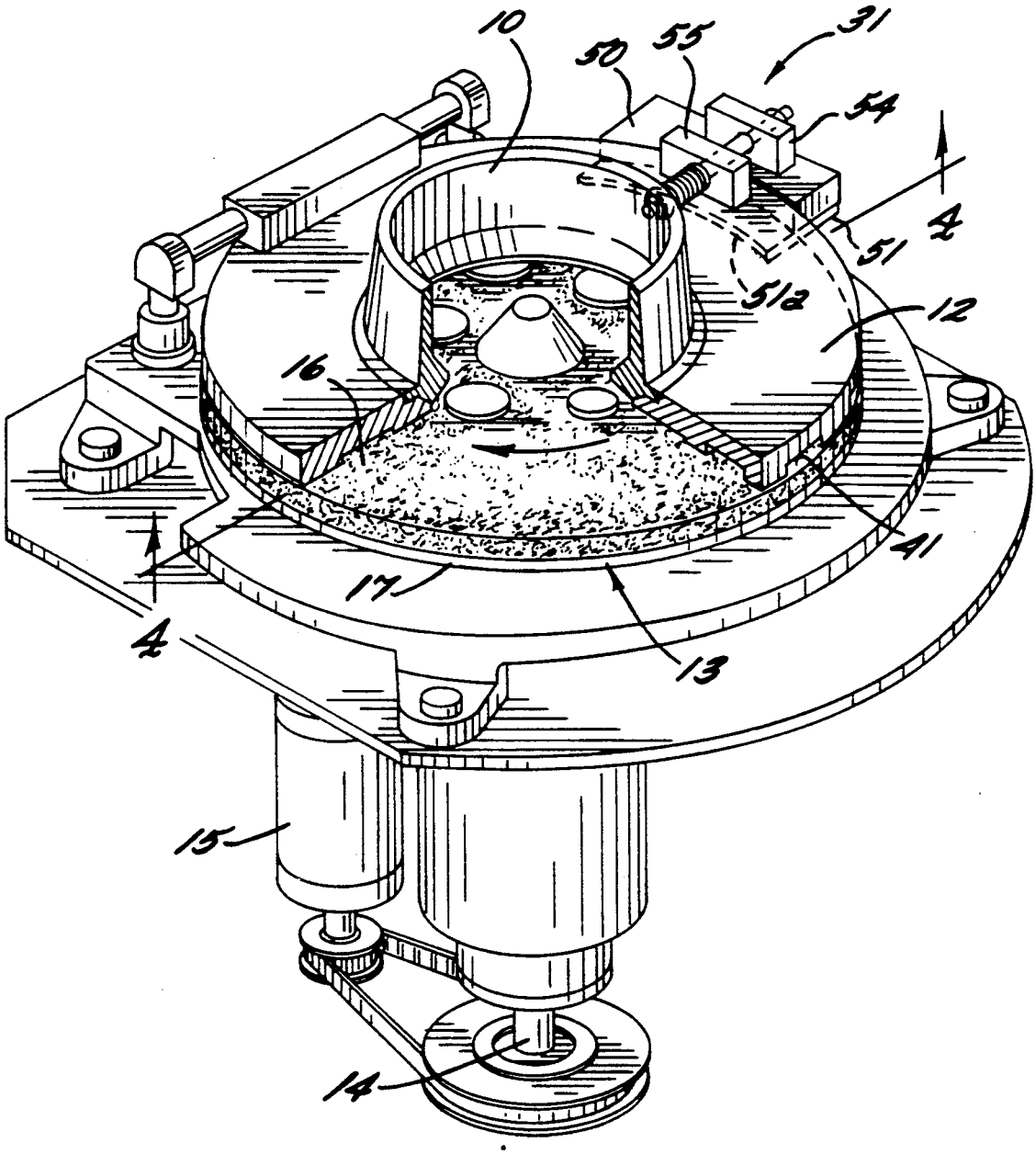
FIG. 1 is a perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular from described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a central opening in an annular sorting head or guide plate 12. As the coins pass through the central opening, they are deposited on the top surface of a rotatable disc 13. This disc 13 is mounted for rotation on a stub shaft (not shown) and driven by an electric motor 15. The disc 13 comprises a resilient pad 16, preferably made of a resilient rubber or polymeric material, bonded or held to the top surface of a rigid disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

Figure 4:
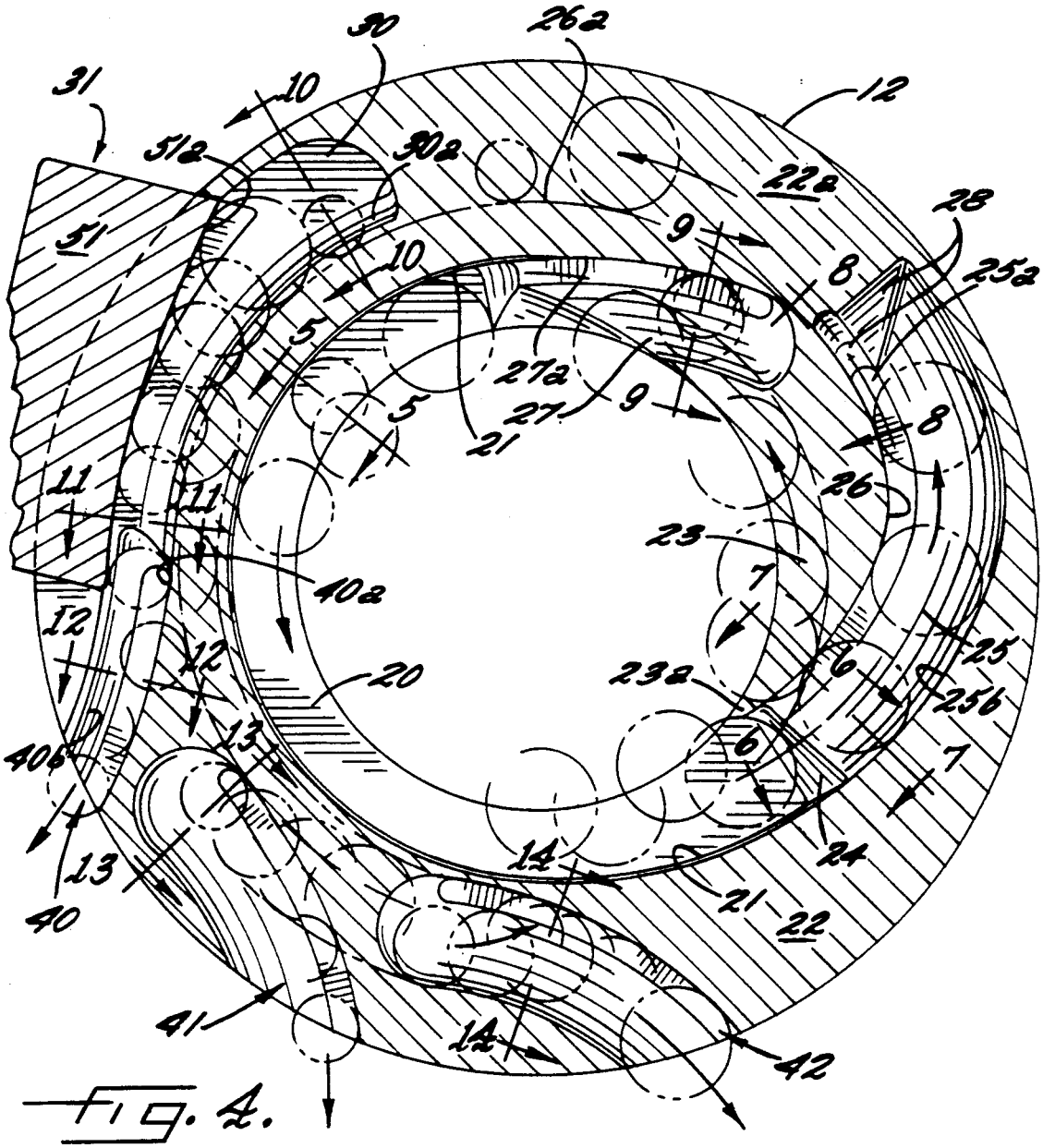
FIG. 4 is a bottom plan view of the sorting head in the coin sorter of FIGS. 1-3.
Figure 5:
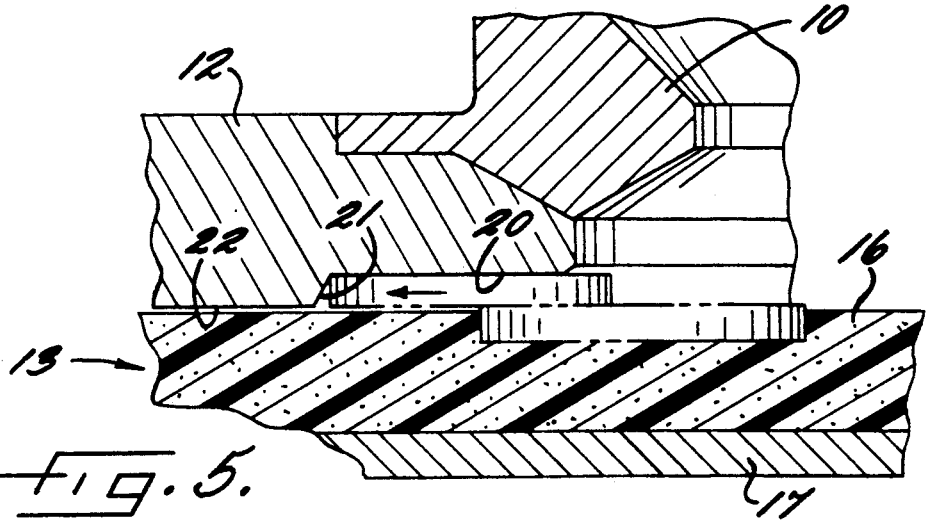
FIG. 5 is an enlarged section taken generally along line 5—5 in FIG. 4.

As can be seen most clearly in FIG. 4, the outwardly moving coins initially enter an annular recess 20 formed in the underside of the guide plate 12 and extending around a major portion of the inner periphery of the annular guide plate. The outer wall 21 of the recess 20 extends downwardly to the lowermost surface 22 of the guide plate (see FIG. 5), which is spaced slightly from the top surface of the pad 16, e.g., by 0.010 inch, which is a distance slightly less than the thickness of the thinnest coins. Consequently, the initial radial movement of the coins is terminated when they engage the wall 21 of the recess 20, though the coins continue to move circumferentially along the wall 21 by the rotational movement of the pad 16.

The only portion of the central opening of the guide plate 12 which does not open directly into the recess 20 is that sector of the periphery which is occupied by a land 23 whose lower surface is at the same elevation as the lowermost surface 22 of the guide plate. As single-layer coins within the recess 20 approach the land 23, those coins move outwardly around the land 23 and engage a ramp 24 leading into a spiral channel 25 which is an outward extension of the inner peripheral recess 20. The channel 25 is preferably just slightly wider than the diameter of the coin denomination having the greatest diameter. The top surface of the major portion of the channel 25 is spaced away from the top of the pad 16 by a distance that is less than the thickness of the thinnest coin so that the coins are gripped between the guide plate 12 and the resilient pad 16 as they are rotated through the channel 25 (see FIG. 7). Thus, as seen in FIG. 4, coins which move into the channel 25 are all rotated into engagement with the outwardly spiralling inner wall 26, and then continue to move outwardly through the channel 25 with the inner edges of all the coins riding along the spiral wall 26.

Figure 7:
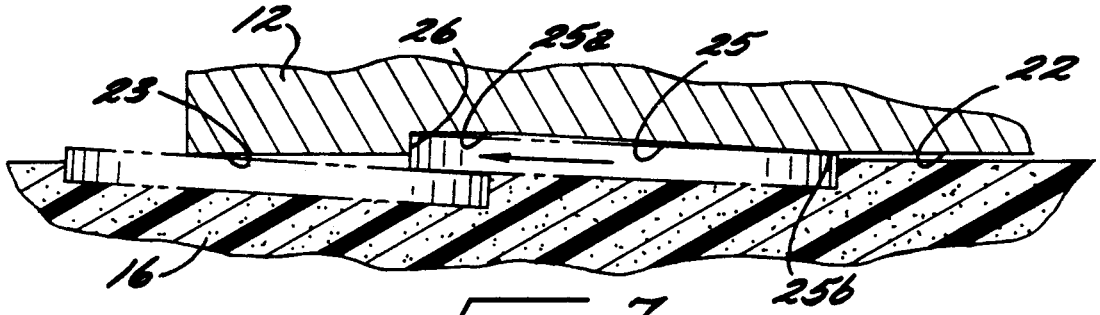
FIG. 7 is an enlarged section taken generally along line 7—7 in FIG. 4.
Figure 16:
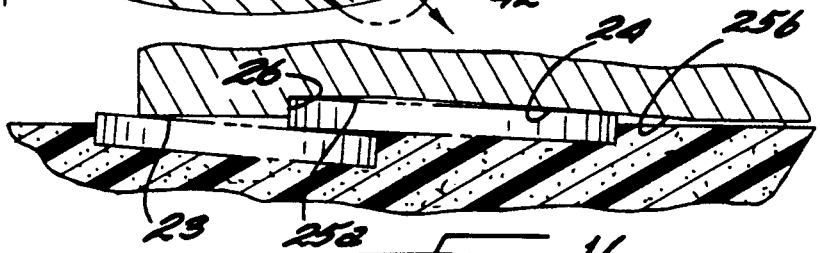
FIG. 16 is a section taken generally along line 16—16 in FIG. 15.

When two or more coins are stacked on top of each other, they may be pressed into the resilient pad 16 even within the deep peripheral recess 20, as shown in FIGS. 4 and 7. Consequently, stacked coins can be located at different radial positions within the recess 20 as they approach the land 23. When such a pair of stacked coins has only partially entered the recess 20, they are cammed outwardly into the spiral channel 25 where they are rotated into engagement with the inner wall 26 of the channel 25. Similarly, when a stacked pair of coins has moved radially out into the recess 20 before reaching the land 23, those stacked coins also engage the inner spiral wall 26. The vertical dimension of the wall 26 is slightly less than the thickness of the thinnest coin, so the lower coin in a stacked pair passes beneath the wall and is recycled while the upper coin in the stacked pair is cammed outwardly along the wall 26. Thus, as shown in FIG. 16, the two coins are stripped apart with the upper coin moving along the guide wall 26, while the lower coin is recycled across the land surface 23.

Coins which pass beneath the wall 26 are rotated across the land 23 into a recycle channel 27 which guides those coins along the outer vertical wall 27*a* back into the recess 20. Such coins are then recirculated along the wall 21 back to the spiral channel 25 (see FIGS. 4, 9, 15 and 16).

Figure 6:
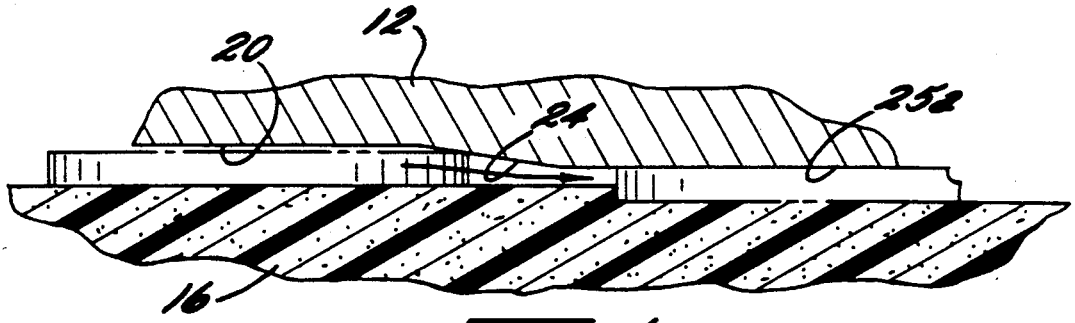
FIG. 6 is an enlarged section taken generally along line 6—6 in FIG. 4.

As can be seen in FIGS. 4, 6 and 7, a narrow band 25*a* of the top surface of the channel 25 adjacent its inner wall 26 is spaced away from the pad 16 by approximately the thickness of the thinnest coin. This ensures that coins of all denominations (but only the upper coin in a stacked or shingled pair) are securely engaged by the wall 26 as it spirals outwardly. The remainder of the top surface of the channel 25 tapers downwardly from the band 25*a* to the outer edge 25*b* of the channel 25. This taper causes the coins to be tilted slightly as they move through the channel 25, as can be seen in FIG. 7, thereby further ensuring continuous engagement of the coins with the outwardly spiralling inner wall 26.

Figure 8:
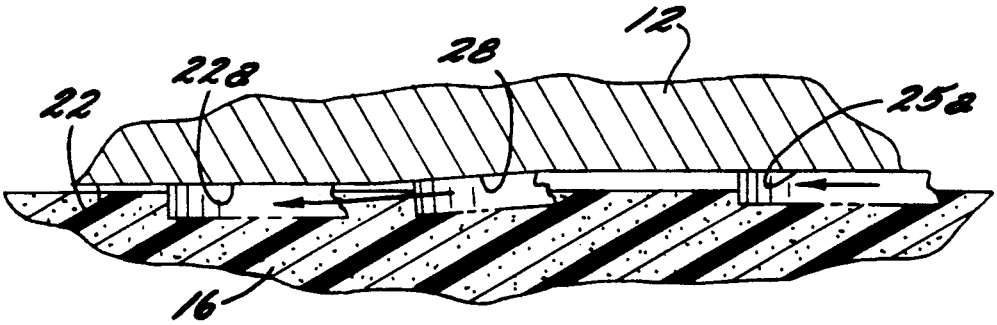
FIG. 8 is an enlarged section taken generally along line 8—8 in FIG. 4.
Figure 9:
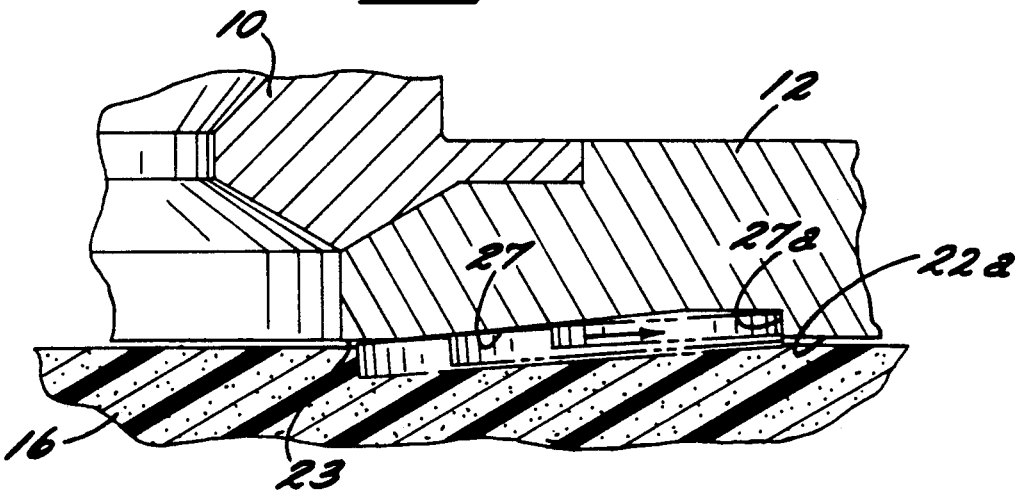
FIG. 9 is an enlarged section taken generally along line 9—9 in FIG. 4.

Rotation of the pad 16 continues to move the coins along the wall 26 until those coins engage ramps 28 sloping downwardly from the channel 25—25*a* to a region 22*a* of the lowermost surface 22 of the guide plate 12 (see FIG. 8). Because the surface 22*a* is located even closer to the pad 16 than the inner portion of the channel 25 (see FIG. 7), the effect of the ramps 28 is to further depress the coins into the resilient pad 16 as the coins are advanced along the ramp by the rotating disc. This causes the coins to be even more firmly gripped between the guide plate surface region 22*a* and the resilient pad 16, thereby securely holding the coins in a fixed radial position 26*a* as they continue to be rotated along the underside of the guide plate by the rotating disc.

Figure 10:
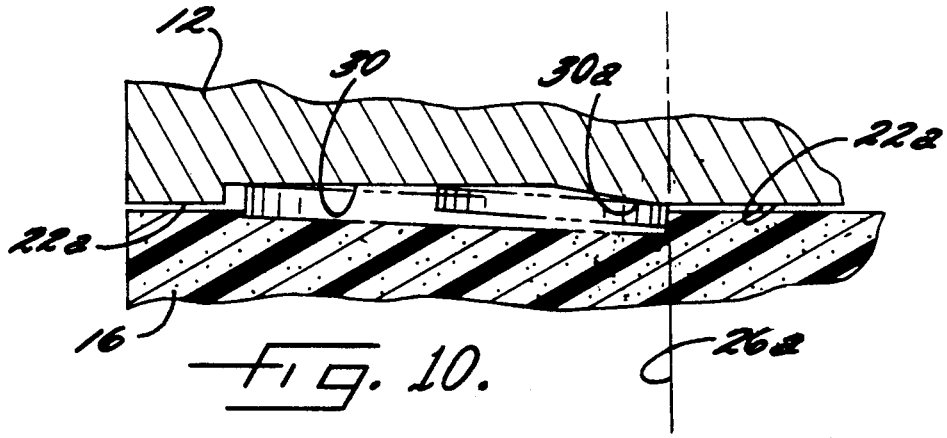
FIG. 10 is an enlarged section taken generally along line 10—10 in FIG. 4.
Figure 11:
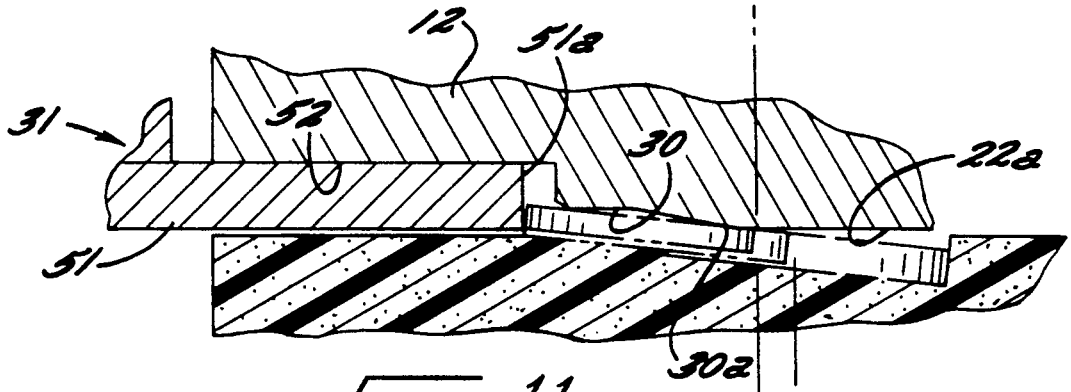
FIG. 11 is an enlarged section taken generally along line 11—11 in FIG. 4.
Figure 11A:
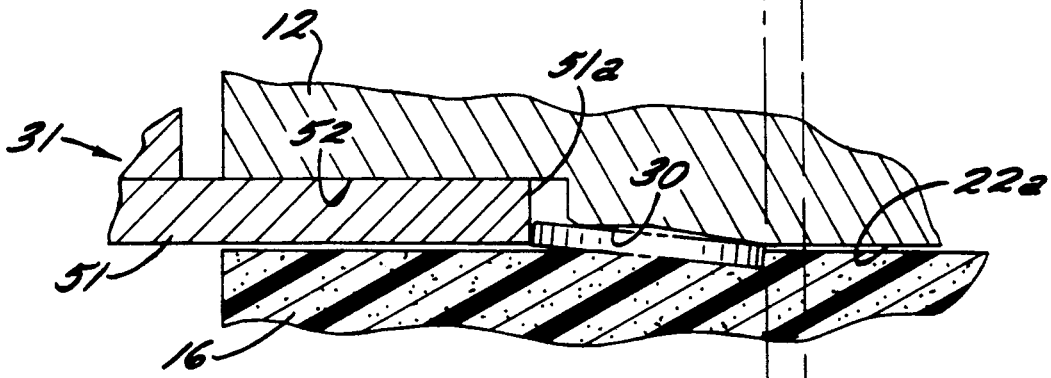
FIG. 11*a* is the same section shown in FIG. 11 but with the movable guide member in a different operative position.

As the coins are rotated along the region 22*a*, they enter a referencing region containing an arcuate recess 30 (FIG. 10) whose inner edge 30*a* follows a radius slightly larger than that of the inner edges 26*a* of the coins (as determined by the radius 26*a* of the end of the spiral inner wall 26—see FIG. 4). Thus, all coin denominations are still pressed firmly against the resilient pad 16. Within the referencing recess 30, a movable arcuate guide member 31 (FIGS. 4, 11 and 11*a*) is positioned to engage the outer edges of selected coin denominations (as well as denominations of larger diameter than the selected denominations) and displace the engaged coins radially inwardly. The radial position of this guide member 31 determines which coin denominations are discharged via each of three exit channels 40, 41 and 42 formed in the guide plate 12 downstream of the guide member 31.

The exit channels 40, 41 and 42 function as selecting means to discharge coins of different denominations at different circumferential locations around the periphery of the guide plate 12. Thus, the channels 40–42 are spaced circumferentially around the outer periphery of the plate 12, with the innermost edges of successive channels located at different radial positions for receiving and ejecting coins of different denominations. The coins of any denominations that reach a given exit channel with their innermost edges extending inwardly beyond the innermost edge of that particular channel cannot enter the channel and, therefore, continue on to the next exit channel.

Figure 12:
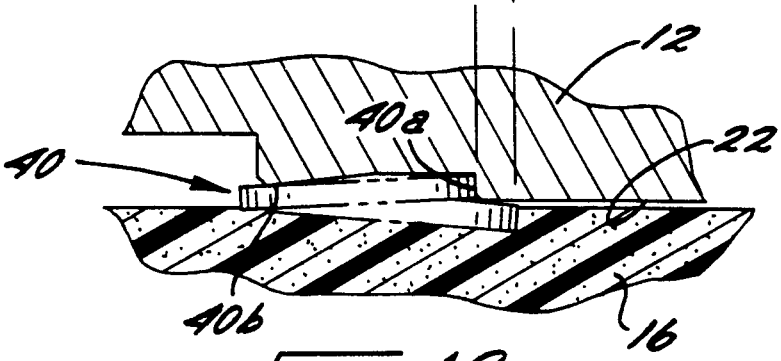
FIG. 12 is an enlarged section taken generally along line 12—12 in FIG. 4.
Figure 13:
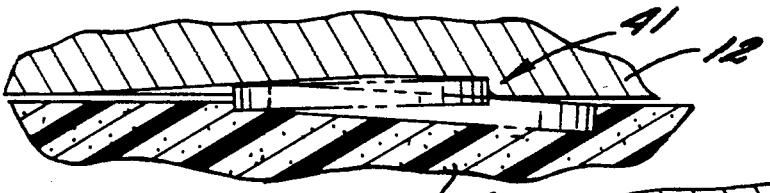
FIG. 13 is an enlarged section taken generally along line 13—13 in FIG. 4.
Figure 14:
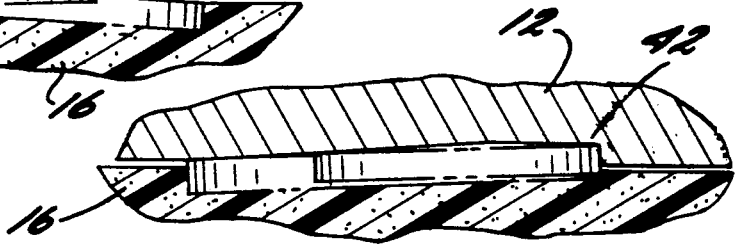
FIG. 14 is an enlarged section taken generally along line 14—14 in FIG. 4.
Figure 15:
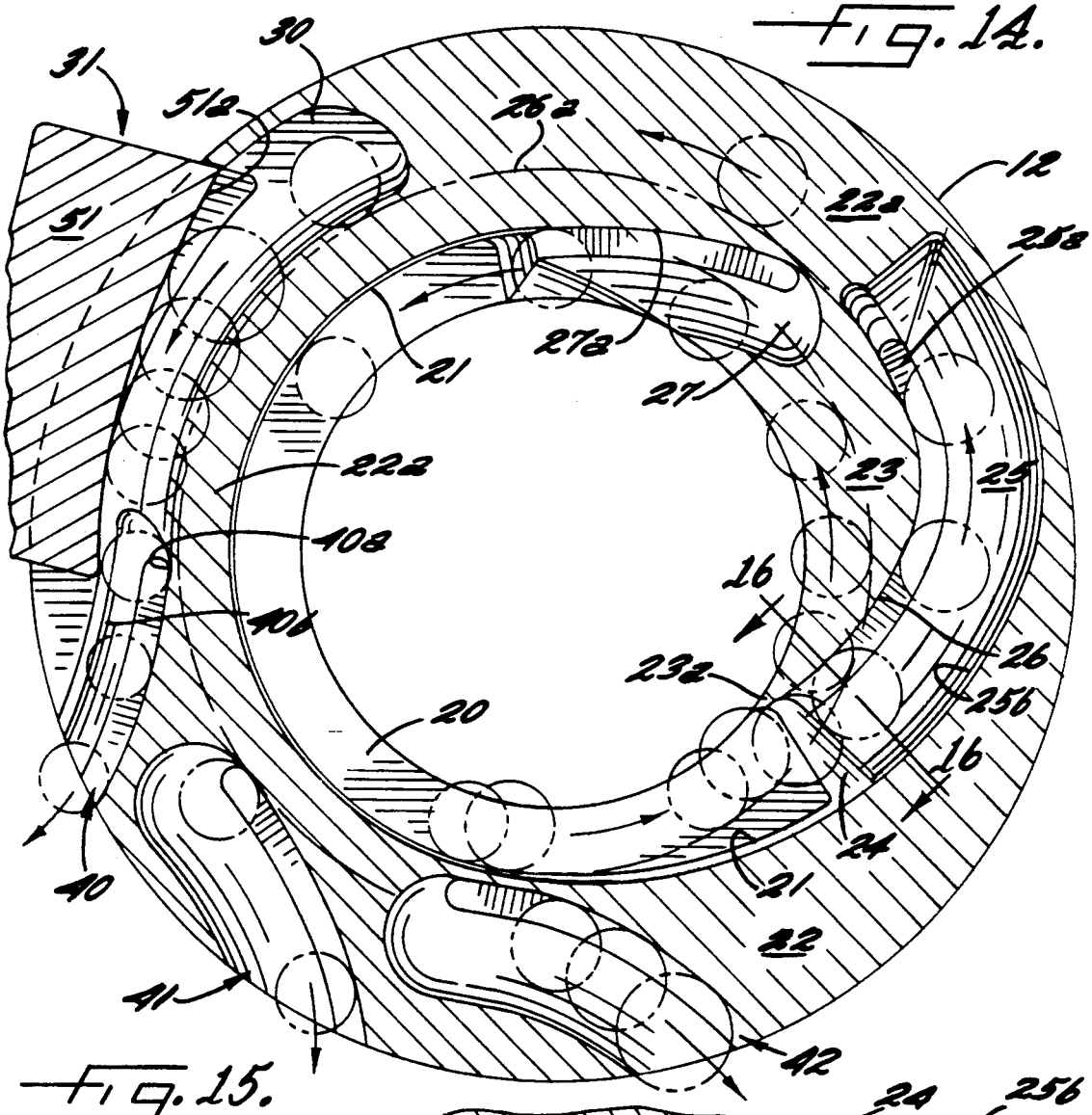
FIG. 15 is the same bottom plan view of the sorting head shown in FIG. 4 but with the movable guide member in a different operative position.

The cross-sectional profile of the three exit channels 40, 41 and 42 are shown in FIGS. 12, 13 and 14, respectively. At least a portion of the width of each exit channel has a depth 40*b* (FIG. 12) that is less than the thickness of the thinnest coin, so that all coins are pressed into the resilient pad 16 as the coins are discharged through any of the three channels 40–42. The width of the two exit channels 41 and 42 is just slightly greater than the diameter of the coin denomination having the largest diameter (e.g., the half dollar in U.S. coins) so that these two channels can receive coins of any denomination. The exit channel 40 has a width slightly smaller than the diameter of the largest coin denomination so that this channel can receive all but the largest of the coins. All three exit channels 40–42 extend outwardly to the periphery of the guide plate 12 so that the inner edges of the channels guide the respective coins therein outwardly and eventually discharge those coins from between the guide plate 12 and the resilient pad 16 (FIG. 1).

The position of the adjustable guide member 31 determines the radial positions of the inner edges of all coin denominations which engage that guide member. The radial positions of those inner edges, in turn, determine which coin denominations are captured in each of the two exit recesses 41 and 42. All coin denominations which do not engage the guide member 31 continue past the guide member with their inner edges still at the radial position 26*a* set by the end of the spiral wall 26;

consequently, all these coins are captured in the first exit channel 40 because the innermost edge 40*a* of the channel 40 is located at a radius just slightly smaller than the radius 26*a* of the downstream end of the spiral wall 26.

For example, if the guide member 31 is positioned to select pennies (see FIGS. 2–4), it displaces pennies and all coin denominations having diameters larger than that of the penny. Thus, as shown in FIG. 4, all coin denominations except the dime will be displaced inwardly. Dimes will then be discharged via the first exit channel 40 (FIG. 12), pennies will be discharged via the second exit channel 41 (FIG. 13), and all other coins will be discharged via the third exit channel 41 (FIG. 14). If the guide member is positioned to engage nickels and all larger coins (see FIG. 15), both dimes and pennies will be discharged via the first exit channel 40, nickels will be discharged via the second exit channel 41, and quarters, dollars and half dollars will be discharged via the third exit channel 42. Of course, the coin mixture being sorted will not always contain all six coin denominations.

The adjustable guide member 31 permits a sorter which is relatively simple and small, and therefore relatively inexpensive, to be used for virtually any coin-sorting application. In actual use, many coin sorters are used primarily to sort only three denominations of coins, such as in sorting the coins collected from vending machines or pay telephones. And yet if there is an occasional need to sort different denominations, or more than three denominations, or to sort out tokens, the guide member can be adjusted to sort any desired combination. To sort a batch of coins containing more than three denominations, the guide member is set to sort two denominations initially, and is then re-set to sort the remaining denominations.

For example, in a typical application the adjustable guide member 31 is set to sort a mixture of dimes, nickels and quarters by discharging dimes via the first exit channel 40, nickels via the second exit channel 41, and quarters via the third exit channel 42. Then if it is desired to use that same sorter to sort pennies, dollars, and half dollars, the guide member is re-positioned so that pennies are discharged via the first channel 40, dollars via the second channel 41 and half dollars via the third channel 42. To sort a mixture of dimes, pennies, nickels, quarter and half dollars, the guide member is initially set to discharge dimes via exit channel 40, pennies via exit channel 41 and the other three denominations via exit channel 42; the guide member is then re-set to discharge nickels via channel 40, quarters via channel 41 and half dollars via channel 42, and the three denominations discharged from exit channel 42 are fed through the sorter again.

Figure 2:
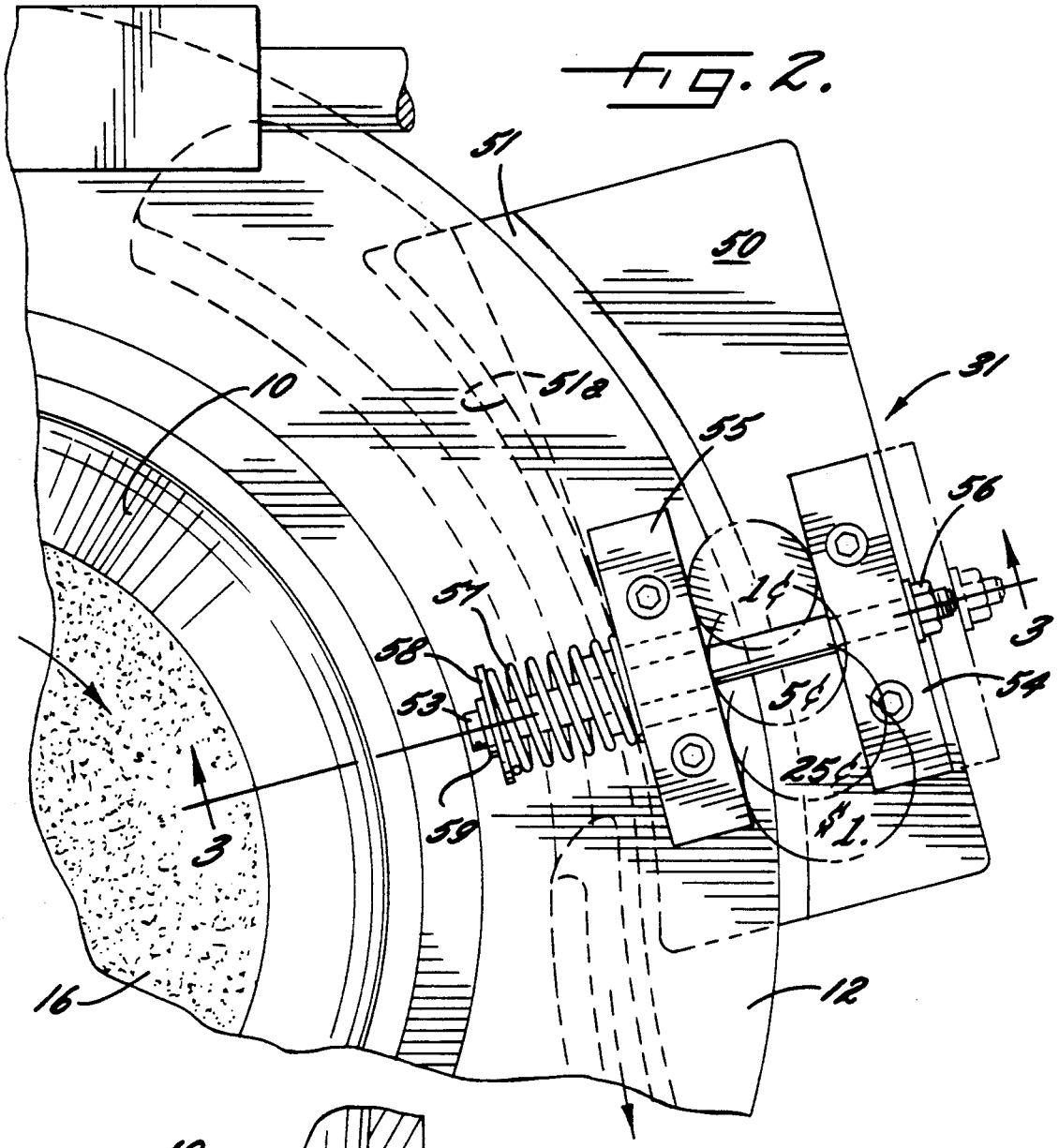
FIG. 2 is an enlarged fragmentary top plan view of a portion of the coin sorter shown in FIG. 1.
Figure 3:
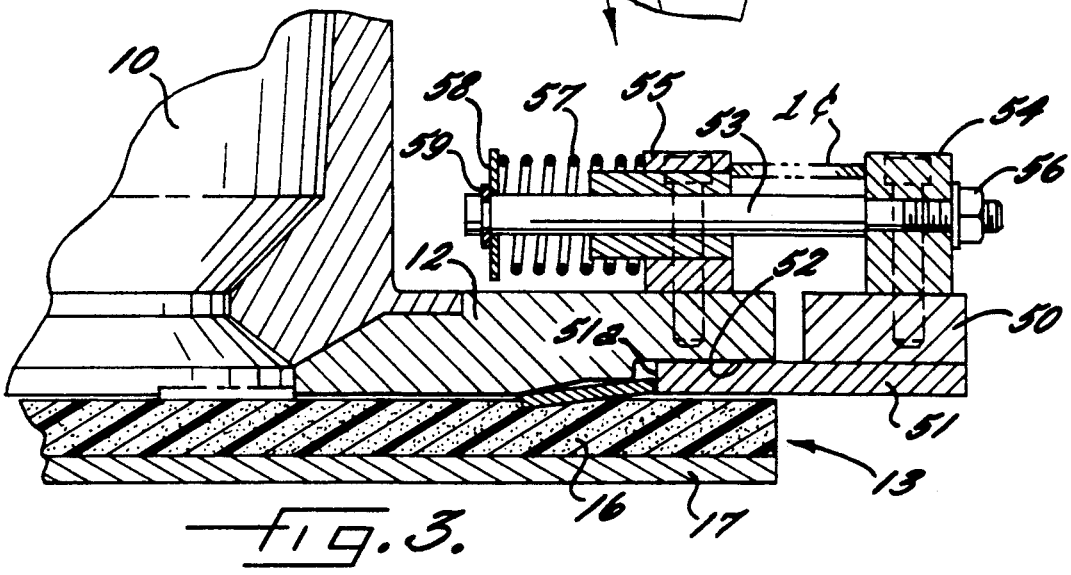
FIG. 3 is a section taken generally along line 3—3 in FIG. 2.

A preferred construction for the adjustable guide member 31 is shown in FIGS. 2 and 3. In this embodiment, the guide member 31 comprises a metal block 50 mounted on the outer periphery on the guide plate 12 and forming a thin guide plate 51 which is cantilevered into a complementary recess 52 formed in the lower surface of the guide plate 12 along its outer periphery. The inner edge 51*a* of the plate 51 forms the adjustable guide surface which engages the outer edges of selected coin denominations.

The major portion of the block 50 extends upwardly along the outer periphery of the plate 12 to the top surface of the plate, where the adjustment mechanism is mounted. The adjustment mechanism includes a guide rod 53 which extends in a radial direction and passes through a pair of bushing blocks 54 and 55. The outer bushing block 54 is fastened to the block 50, and the inner bushing block 55 is fastened to the top of the guide plate 12. The outer end of the guide rod 53 is held in place by a nut 56 threaded onto a reduced end portion of the guide rod, and the inner end of the rod 53 receives a coil spring 57 which is compressed and held in place by a plate 58 and a locking washer 59 inserted into a groove near the inner end of the guide rod 53. The spring 57 applies a constant inward radial force to the outer bushing block 54, urging that block toward the inner bushing block 55. The inner block 55 is rigidly fixed to the stationary guide plate 12, while the outer bushing block 54 is carried on the movable block 50.

Consequently, the space between the two bushing blocks 54 and 55 determines the radial position of the coin-guiding inner edge 51*a* of the cantilevered plate 51. As illustrated in FIGS. 2 and 3, this critical space between the two bushing blocks 54 and 55 may be set by inserting a coin of the desired denomination between the opposed surfaces of the blocks 54 and 55. For example, if a penny is inserted between the surfaces, the inner edge 51*a* of the guide plate 51 is positioned to engage the outer edges of pennies and all larger coins, thereby causing only pennies to be discharged via the second exit channel 41. All larger coins are exited through the third exit channel 42, while dimes are discharged via the first exit channel 40. It will be recognized, of course, that various other calibrating techniques may be utilized to control the spacing between the two bushing blocks. For example, the bushing blocks could be mounted on a threaded shaft, with a calibrated scale located adjacent the blocks for indicating the proper positions of the blocks for selecting different coin denominations to be discharged via the middle exit channel 41.

Instead of gaging the inner edges of the coins before they reach the adjustable guide member, the coins could be gaged on their outer edges. Indeed, the coins need not be gaged at all, as long as they are in a single layer and in single file as they approach the adjustable guide member.

We claim:

1. A method of sorting coins having a diameter of less than a predetermined dimension from both coins having a diameter equal to said predetermined dimension and coins having a diameter of greater than said predetermined dimension in a disc-type coin sorter, said predetermined dimension corresponding to a specific coin denomination, said disc-type coin sorter having a rotatable disc with a resilient surface for receiving said coins and imparting rotational movement to said coins, and a stationary sorting head having a contoured surface spaced slightly away from and generally parallel to said resilient surface of said rotatable disc, said sorting head forming a plurality of discharge stations spaced along the periphery of said head for selectively discharging coins according to the radial locations of the edges of the coins, said method comprising the steps of:

rotating said disc beneath said sorting head while feeding coins between said disc and sorting head, arranging said coins in a single layer and in single file, and engaging the edges of said coins having a diameter equal to said predetermined dimension and said coins having a diameter greater than said predetermined dimension with an adjustable gauging means having an adjustable radial position and displacing those coins so that coins having a diameter equal to said predetermined dimension and said coins having a diameter greater than said predetermined dimension are positioned to be discharged via different ones of said discharge stations than said coins having a diameter less than said predetermined dimension, said adjustable gauging means being alterable so that said predetermined dimension corresponds with a different denomination of coin to change the coin denominations that are discharged at said discharge stations, whereby different combinations of coin denominations may be sorted and discharged at said discharge stations by altering said predetermined dimension.

2. The method of claim 1 wherein said arranging step aligns the inner edges of all the coins along a common path so that the outer edges of coins of different denominations are offset from each other, said common path corresponding to the radial location of the inner edges of the coins that are discharged at the first discharge station.

3. The method of claim 1 wherein said discharge stations comprise exit channels formed in said sorting head, the edges of said exit channels being radially offset from each other for receiving coins having their corresponding edges located at different radial positions, and wherein said step of engaging and displacing said coins having a diameter equal to said predetermined diameter and said coins having a diameter greater than said predetermined dimension causes alignment coins having a diameter less than said predetermined dimension to be discharged from the discharge station having the exit channel with the outermost radial position.

4. The method of claim 1 wherein the inner edges of said coins are aligned along said common path by pressing said coins into said resilient surface while moving said coins circumferentially along an outwardly spiralling guide wall formed in said sorting head.

5. The method of claim 1 wherein coins having a diameter not less than said predetermined dimension are engaged and displaced radially by an adjustable guide surface on said sorting head.

6. A coin sorting apparatus for receiving and sorting mixed coins by denomination, said apparatus comprising a rotatable disc having a resilient surface for receiving said mixed denomination coins and imparting rotational movement to said mixed denomination coins, means for rotating said disc, a stationary sorting head having a contoured surface spaced slightly away from and generally parallel to said resilient surface of said rotatable disc, said sorting head including means for queuing the coins on said disc into a single file of coins, and a guiding edge which engages the radially inner edges of the coins in said single file and guides said coins along a prescribed path where the positions of the radially outer edges of the coins are determined by the diameters of the respective coins, sorting means for discriminating among coins of different denominations and selecting coins of different denominations for discharge from said rotating disc at different locations around the periphery of said stationary sorting head, said sorting means including at least three coin-discharge channels spaced around the periphery of said sorting head and having their innermost edges at different radial positions for receiving coins of different denominations according to the radial locations of the inner edges of the coins, the innermost edges of the first of said coin-discharge channels being aligned with said prescribed path, and the innermost edge of the other coin-discharge channels being spaced radially inwardly from the innermost edge of said first channel, and adjustable gaging means disposed between said guiding edge and said first discharge channel for engaging the outer edges of coins of a selected denomination and any denominations having a larger diameter than said selected denomination, said gaging means displacing the engaged coins radially inwardly so that the inner edges of the coins of said selected denomination are aligned with the innermost edge of the second discharge channel so that coins of said selected denomination enter said second channel.

7. The coin sorting apparatus of claim 6 wherein the inner edges of coins of at least one denomination having a diameter larger than said selected denomination are located at a radius at least as large as that of the innermost edge of the third discharge channel so that such coins enter said third discharge channel.

8. The coin sorting apparatus of claim 6 wherein said discharge stations comprise exit channels formed in said sorting head, the inner edges of said exit channels being radially offset from each other for receiving coins having their inner edges located at different radial positions.

9. The coin sorting apparatus of claim 6 which includes means for pressing said coins into said resilient surface as said coins leave said guiding edge, and said guiding edge comprises an outwardly spiralling guide wall formed in said sorting head.

10. The coin sorting apparatus of claim 6 which includes an adjustable guide surface on said sorting head for engaging the outer edges of said selected denominations of coins and moving the engaged coins radially inwardly.

11. A method of sorting a plurality of denominations of coins in a disc-type coin sorter, each of said plurality of denominations of coins having a unique diameter corresponding thereto, wherein coins having a diameter smaller than a first predetermined dimension corresponding to one of said plurality of denominations of coins are sorted from coins having a diameter equal to said first predetermined dimension and coins having a diameter greater than said predetermined dimension, said disc-type coin sorter having a rotatable disc with a resilient surface for receiving said coins and imparting rotational movement to said coins, and a stationary sorting head having a contoured surface spaced slightly away from and generally parallel to said resilient surface of said rotatable disc, said sorting head forming a plurality of discharge stations spaced along the periphery of said head for selectively discharging coins according to the radial locations of the edges of the coins, said method comprising the steps of:

rotating said disc beneath said sorting head while feeding coins between said disc and said sorting head;

arranging said coins in a single layer and in single file;

engaging the edges of coins having a diameter equal to said predetermined dimension and said coins having a diameter greater than said first predetermined dimension with an adjustable gauging means having an adjustable radial position initially corresponding to said first predetermined dimension to displace those coins so that they are positioned to be discharged in different ones of said discharge stations than coins having a diameter less than said first predetermined dimension; and altering the radial position of said adjustable gauging means to correspond to a second predetermined dimension, said second predetermined dimension corresponding to the diameter of a coin of a different denomination than said first predetermined dimension.

* * * * *